US008197000B1

(12) United States Patent
Cohen

(10) Patent No.: US 8,197,000 B1
(45) Date of Patent: Jun. 12, 2012

(54) CHAIR STRUCTURE HAVING AUXILIARY BACKREST LEG AND ACCOMMODATING BACKREST POCKETS

(76) Inventor: Warren Cohen, Philadelphia, PA (US)

( * ) Notice: Subject to any disclaimer, the term of this patent is extended or adjusted under 35 U.S.C. 154(b) by 284 days.

(21) Appl. No.: 12/582,835

(22) Filed: Oct. 21, 2009

Related U.S. Application Data

(63) Continuation-in-part of application No. 11/998,939, filed on Dec. 4, 2007, now abandoned.

(51) Int. Cl.
*A47C 4/00* (2006.01)
*A47C 7/62* (2006.01)

(52) U.S. Cl. ..... 297/17; 297/188.04

(58) Field of Classification Search ..... 297/17, 297/21, 22, 29, 188.04, 188.07
See application file for complete search history.

(56) References Cited

U.S. PATENT DOCUMENTS 1,842,424 A * 1/1932 Ponten et al. ..... 297/377
3,828,992 A * 8/1974 Cerchione ..... 224/156
4,530,451 A * 7/1985 Hamilton ..... 224/155
4,676,548 A * 6/1987 Bradbury ..... 297/129
4,947,498 A * 8/1990 Van Boxtel ..... 5/113
5,538,318 A * 7/1996 MacLean ..... 297/129
5,628,443 A * 5/1997 Deutsch ..... 224/583
5,733,000 A * 3/1998 Stump ..... 297/188.06
6,250,712 B1 * 6/2001 Livington et al. ..... 297/4

* cited by examiner

*Primary Examiner* — Sarah B McPartlin
(74) *Attorney, Agent, or Firm* — LaMorte & Associates

(57) ABSTRACT

A chair assembly that contains both an auxiliary leg and at least one rear pocket that extend from the rear of the backrest. The chair assembly has a seat and a leg framework that supports the seat at a predetermined elevation. A backrest is provided that is adjustable between a generally vertical position and a generally horizontal position. At least a first pocket extends outwardly from the rear surface of the backrest. The auxiliary leg is connected to the rear of the backrest above the first pocket. The auxiliary leg can be folded against the backrest or rotated to a position where it extends away from the backrest. When in its folded position, the auxiliary leg extends around the periphery of the first pocket. In this manner, the auxiliary leg and the first pocket do not physically interfere with each other.

17 Claims, 7 Drawing Sheets

CHAIR STRUCTURE HAVING AUXILIARY BACKREST LEG AND ACCOMMODATING BACKREST POCKETS

RELATED APPLICATIONS

This application is a continuation-in-part of U.S. patent application Ser. No. 11/998,939, filed Dec. 4, 2007 now abandoned and entitled, Backpack Chair Structure With Reinforced Strapping.

BACKGROUND OF THE INVENTION

1. Field of the Invention

The present invention relates to the structure of folding chairs made from metal tubing and fabric. More particularly, the present invention relates to the structure of folding chairs having a backrest that can be adjusted to a nearly horizontal orientation.

2. Description of the Prior Art

There are many types and styles of folding chairs. Most folding chairs have a foldable rigid frame. Flexible material is attached to the rigid frame and folds with the rigid frame. When the folding chair is opened, the flexible material is supported by the rigid frame as the seating surface.

A majority of folding chairs have a backrest that is oriented near the vertical and is either not adjustable or adjustable only to a small degree. However, some folding chair designs have backrests that can adjust into a nearly horizontal position so that a person can both sit in the chair and lay flat on the chair. When a folding chair has a backrest that can be adjusted into a near horizontal position, an auxiliary leg is typically provided on the backrest that supports the backrest in this position. The leg prevents the backrest from tipping below the horizontal position when a person lays on the chair.

Although the auxiliary leg is sometimes necessary to make a stable chair, the auxiliary leg prevents certain other features from being added to a folding chair. Since the auxiliary leg extends behind the backrest, the auxiliary leg prevents pockets from being placed on the rear of backrest. The presence of the auxiliary leg also prevents the folding chair from being fitted with shoulder straps so that it can be carried as a backpack.

In the prior art record, there are many kinds of folding chair designs that have shoulder straps. In this manner, the folding chair can be carried on the back when not in use. With some prior art designs, only the light folding chair itself is intended to be carried by the shoulder straps. However, in other folding chair designs, the folding chair serves not only as a chair but also as a functional backpack. A chair that serves as a functional backpack must have pockets for holding items. Due to the orientation of the chair, the pockets must be located on the rear surface of the backrest. However, this is the same area that is occupied by the auxiliary leg. Consequently, chair manufacturers are required to choose between providing a folding chair with an auxiliary leg that enables the chair to lay flat, or making a folding chair with pockets that can be used as a backpack.

A need therefore exists for a backpack chair design that enables the backpack chair to both function as a backpack and also have an auxiliary leg that enables the backrest of the folding chair to lay flat. This need is met by the present invention as described and claimed below.

SUMMARY OF THE INVENTION

The present invention is a chair assembly that contains both an auxiliary leg and at least one rear pocket that extends from the rear of the backrest. The chair assembly has a seat and a leg framework that supports the seat at a predetermined elevation. A backrest is provided that is adjustable between a generally vertical position and a generally horizontal position.

At least a first pocket extends outwardly from the rear surface of the backrest. The auxiliary leg is connected to the rear of the backrest above the first pocket. The auxiliary leg can be folded against the backrest or rotated to a position where it extends away from the backrest. When in its folded position, the auxiliary leg extends around the periphery of the first pocket. In this manner, the auxiliary leg and the first pocket do not physically interfere with each other.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
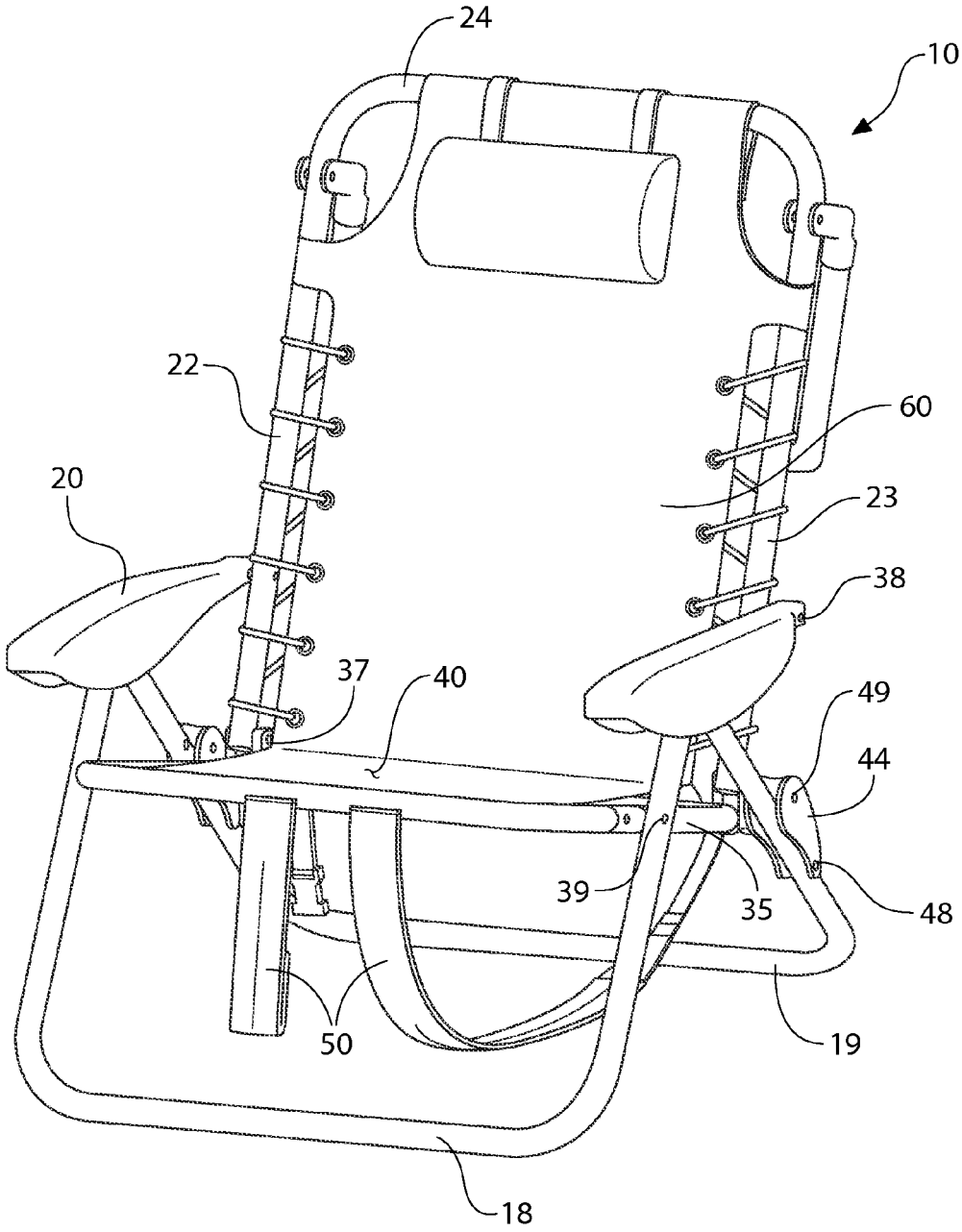
FIG. 1 is a perspective view of an exemplary embodiment of the present invention folding backpack chair.
Figure 2:
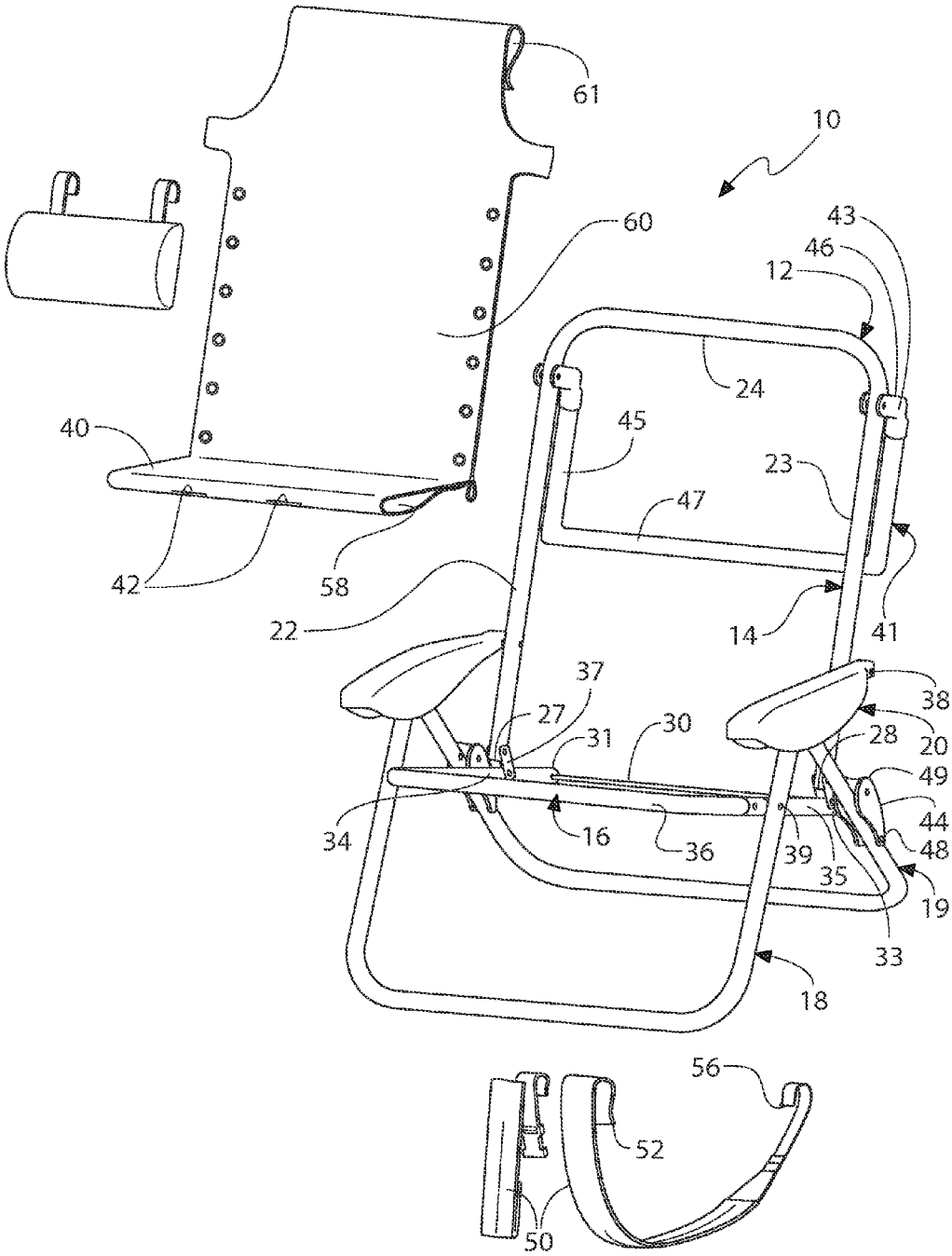
FIG. 2 is an exploded view of the exemplary embodiment of FIG. 1.

Referring to FIG. 1 and FIG. 2, an exemplary embodiment of a folding backpack chair 10 is shown. The folding backpack chair 10 has a framework 12 that includes a backrest frame 14, a seat frame 16, a front leg frame 18, a rear leg frame 19 and armrests 20. The framework 12 of the folding backpack chair 10 is foldable so that the backpack chair 10 can be selectively configured between a folded condition and an open condition.

The backrest frame 14 is generally U-shaped and consists of two side elements 22, 23 and a crossbar element 24 that joins the two side elements 22, 23. In the shown embodiment, the side elements 22, 23 and the crossbar element 24 are made from a single bent length of aluminum tubing. However, many other equivalent construction techniques and materials can be used. Due to the general U-shape of the backrest frame 14, the side elements 22, 23 have free ends 27, 28 that face away from the crossbar element 24. The backrest frame 14 is rigid and defines a large area that does not change shape as the folding backpack chair 10 is moved between its folded condition and open condition.

The seat frame 16 also contains two side elements 34, 35 and a crossbar element 36. Again, in the shown embodiment, the side elements 34, 35 and the crossbar element 36 are made from a single piece of bent tubing. Due to the general U-shape of the seat frame 16, the side elements 34, 35 have free ends 31, 33 that face away from the crossbar element 36. A connector rod 30 is provided. The connector rod 30 is preferably a high-strength solid metal rod or thick-walled tube that extends between the side elements 34, of the seat frame 16 proximate the free ends 31, 33. The connector rod 30 lay parallel to the crossbar element 36 and is used to anchor shoulder straps 50, as will be later explained.

The backrest frame 14 and the seat frame 16 are both supported above the ground by the front leg frame 18 and the rear leg frame 19. The front leg frame 18 and the rear leg frame 19 join together at a pivot joint under the armrests 20.

Parallel links 37 connect the backrest frame 14 to the seat frame 16. The links 37 are attached to the side elements 22, 23 of the backrest frame 14 proximate their free ends 27, 28. Those same links 37 engage the side elements 34, 35 of the seat frame 16. However, the links 37 attach to the side elements 34, of the seat frame 16 inches away from its free ends 31, 33. It will therefore be understood that the links 37 attach to the side elements 34, 35 of the seat frame 16 between the crossbar element 24 and the connector rod 30.

The seat frame 16 is connected to the front leg frame 18 by two pin joint connections 39. The pin joint connections 39 join the seat frame 16 to the front leg frame 18 while enabling the seat frame 16 to rotate about the pin joint connections 39 relative to the front leg frame 18.

The backrest frame 14 connects to the ends of the armrests 20 with pin joint connections 38. The pin joint connections 38 join the backrest frame 14 to the armrests 20 while enabling the backrest frame 14 to rotate about the pin joint connections 38 relative to the armrests 20.

The rear leg frame 19 is not directly attached to either the seat frame 16 or the backrest frame 14. Rather, two shaped linkages 44 are provided. Each shaped linkage 44 defines opposing grooves that are shaped to receive the side elements of the rear leg frame 19 when pressed against those elements. Each shaped linkage 44 is attached at its bottom end to the rear leg frame 19 with a pin joint connection 48. The top end of each shaped linkage 44 is attached to the free ends 27, 28 of the backrest frame 14. In the shown embodiment, both the shaped linkages 44 and the parallel links 37 are joined to the free ends 27, 28 of the backrest frame 14 with common pin joint connections 49.

Figure 3:
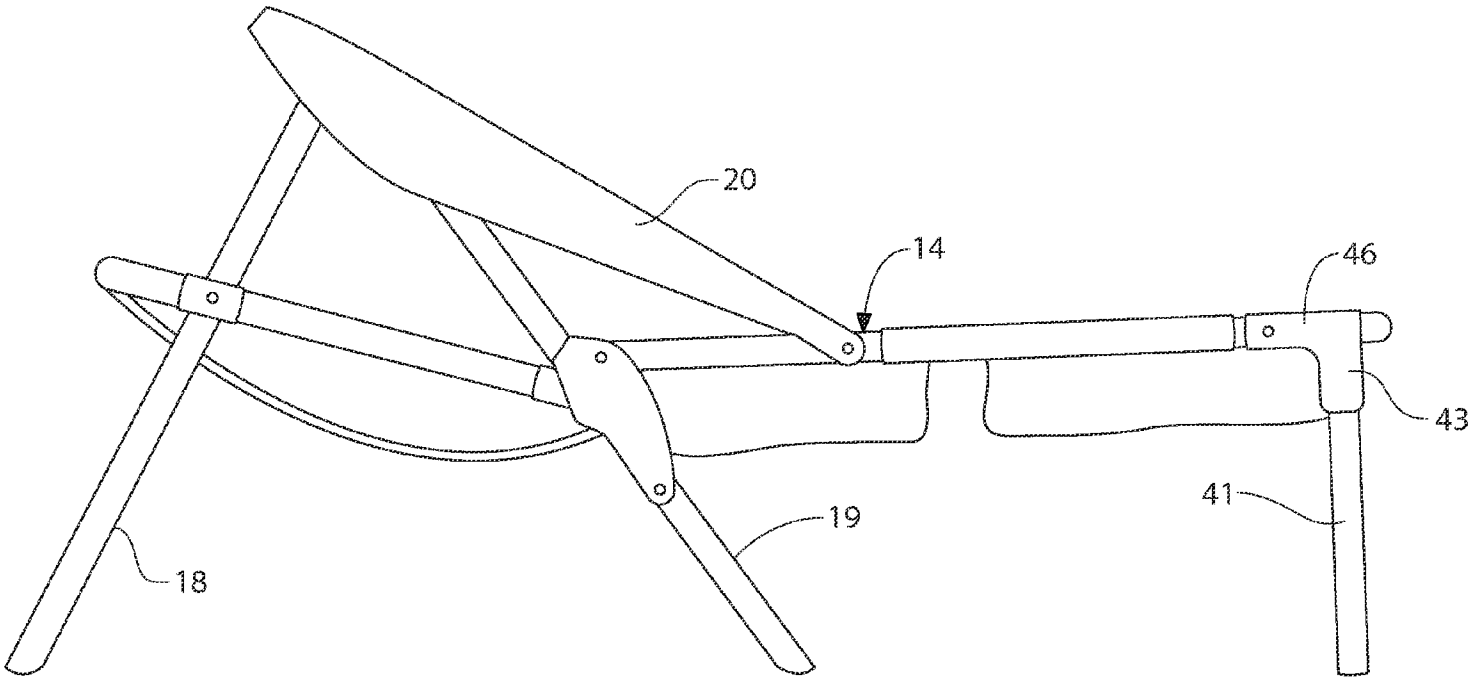
FIG. 3 is a side view of the exemplary embodiment in a reclined orientation.

Referring to FIG. 3 in conjunction with FIG. 2, it can be seen that the backrest frame 14 can be adjusted to a nearly horizontal position by adjusting the point where the front leg frame 18 and the rear leg frame 19 engage the armrests 20. An auxiliary leg 41 is connected to the backrest frame 14 at pivot joints 43, the pivot joints 43 enable the auxiliary leg 41 to either fold flush against the backrest frame 14 or extend at a perpendicular from the backrest frame 14. The pivot joints 43 may contain clip structures 46 that engage the backrest frame 14 and selectively hold the auxiliary leg 41 in its folded position. In the exemplary embodiment, the auxiliary leg 41 is generally U-shaped, having two short arms 45 joined by a long crossbar 47. The arms 45 and crossbar 47 are preferably fabricated from a single piece of bent tubing.

A flexible fabric seat 40 is sewn or otherwise bound to the seat frame 16, wherein the flexible fabric seat 40 creates the seating surface of the folding backpack chair 10. A slip 58 is formed at the front of the flexible fabric seat 40. The crossbar element 36 of the seat frame 16 passes into the slip 58. Two button holes 42 are sewn into the slip 58 along its front edge. The button holes 42 allow the shoulder straps 50 to pass into the slip 58, as will be later explained.

A flexible fabric backrest 60 is also provided. The flexible fabric backrest 60 attaches to the backrest frame 14. The flexible fabric backrest 60 defines an upper slip 61. The upper pocket slip 61 passes over the crossbar element 24 of the backrest frame 14 and the top of the side elements 22, 23.

Figure 4:
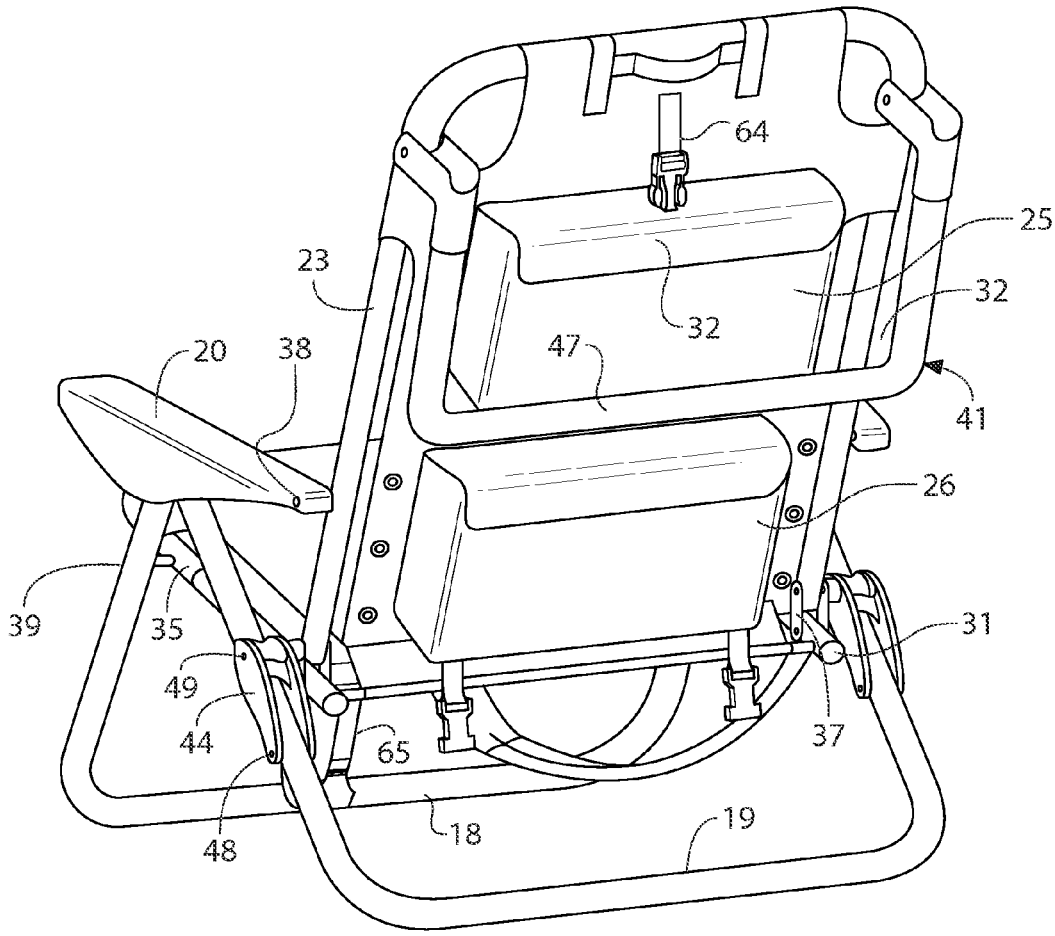
FIG. 4 is a perspective rear view of the exemplary embodiment of FIG. 1 with the auxiliary leg folded.
Figure 5:
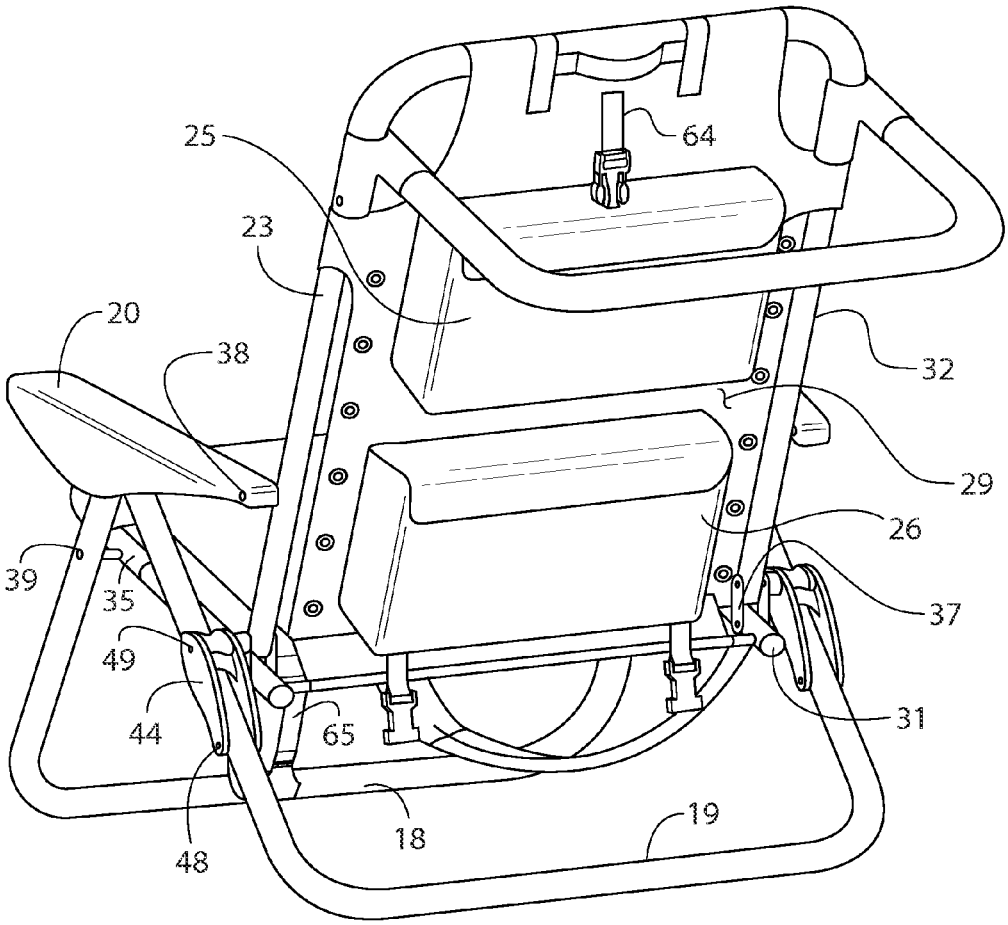
FIG. 5 is a perspective rear view of the exemplary embodiment of FIG. 1 with the auxiliary leg extended.

Referring to FIG. 4 in conjunction with FIG. 5, it can be seen that a first pocket 25 and a second pocket 26 are attached to the rear of the flexible fabric backrest 60. Each of the pockets 25, 26 has the same length and width. Each pocket 25, 26 is oriented so as to have an open top that faces upwardly when the backrest frame 14 is in a vertical position. Each of the pockets 25, 26 also has a closure 32 that may be selectively closed with a zipper or hook and loop material.

The top pocket 25 and/or the bottom pocket 26 may be made from the same material as the seating surfaces. However, each of the pockets 25, 26 may have insulated walls to help the pockets 25, 26 hold hot or cold materials at a more stable temperature.

A straight horizontal gap 29 exists between the top pocket 25 and the bottom pocket 26. As can be seen from FIG. 5, when the auxiliary leg 41 is folded to a closed position, the auxiliary leg 41 lays flush against the backrest frame 16 by passing into the gap 29. The gap 29 is sized to be just wider than the crossbar 47 of the auxiliary leg 41. As such, the crossbar 47 falls neatly between the pockets 25, 26 in the gap 29. Furthermore, the depth of the top pocket 25 is designed to be shallow enough not to interfere with the movement of the auxiliary leg 41 as it rotates between its folded position and extended position.

Figure 6:
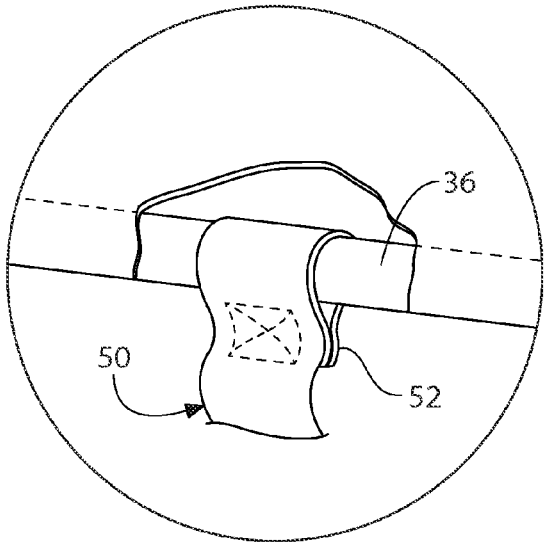
FIG. 6 is an enlarged view showing details of a forward shoulder strap attachment of the folding backpack chair.

Returning to FIG. 2, two shoulder straps 50 are provided that enable the folding backpack chair 10 to be worn on the back. Each of the shoulder straps 50 has two ends 52, 56, wherein each shoulder strap 50 is selectively adjustable in length between the two ends. Referring to FIG. 6 in conjunction with FIG. 2, it can be seen that the first end 52 of each shoulder strap 50 is anchored to the crossbar element 36 that extends between the side elements 34, 35 of the seat frame 16. The first end 52 of each shoulder strap 50 is folded over the crossbar element 36 and sewn in a closed loop, thereby creating a strong mechanical interconnection. The shoulder straps 50 pass through the button holes 42. The material surrounding the button holes 42 holds the shoulder straps 50 stationary on the crossbar element 36 of the seat frame 16. Consequently, the shoulder straps 50 cannot slide and wear against the crossbar element 36.

Figure 7:
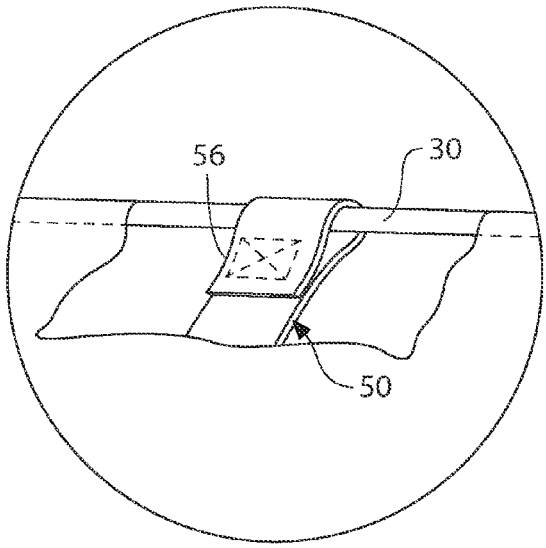
FIG. 7 is an enlarged view showing details of a rearward shoulder strap attachment of the folding backpack chair.

Referring to FIG. 7 in conjunction with FIG. 2, it can be seen that the second end 56 of each shoulder strap 50 attaches to the connector rod 30 of the seat frame 16. The second ends 56 of the shoulder straps 50 are looped around the connector rod 30 and are sewn closed.

Figure 8:
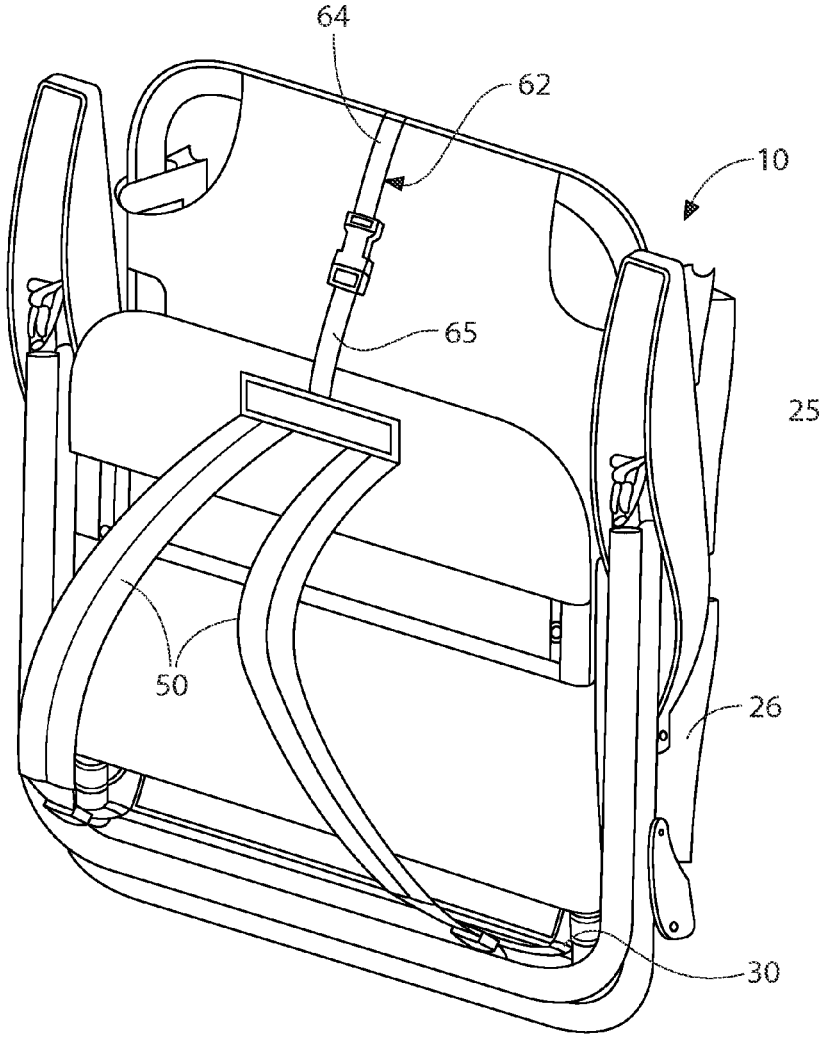
FIG. 8 is a front view of the exemplary embodiment of the present invention shown in a folded condition.

Referring to FIG. 8 in conjunction with FIG. 2, it can be seen that the folding backpack chair 10 includes a locking strap set 62. The locking strap set 62 includes a top strap 64 and a bottom strap 65 with a male/female connector 66 that selectively interconnects the top strap 64 and the bottom strap 65. The top locking strap 64 is connected to the crossbar element 24 of the backrest frame 14. The bottom strap 65 attaches to the crossbar element 36 of the seat frame 16. The top strap 64 and the bottom strap 65 are sized so that they can interconnect only when the folding backpack chair 10 is in its fully folded configuration. Once the top strap 64 and the bottom strap 65 are interconnected, the two straps 64, 65 prevent the folding backpack chair 10 from being opened out of its fully folded configuration.

From FIG. 8 in conjunction with FIG. 4, it will be understood that when the backpack chair 10 is folded, it can be worn as a backpack. Objects to be carried are placed in the top pocket 25 and bottom pocket 26. When the shoulder straps 50 are placed around the shoulders, both ends of the shoulder straps 50 are in tension and pull against the framework of the folding backpack chair 10. The weight being borne by the pockets 25, 26 attempts to pull the folding backpack chair 10 open and out of its folded configuration. This bias is resisted by the locking strap set 62 that holds the folding backpack chair 10 closed. Consequently, the locking strap set 62 is also in tension.

The shoulder straps 50 pull upwardly on the connector rod 30. The locking strap set 62 pulls backward on the crossbar element 36 of the seat frame 16. These two forces apply torque to the seat frame 16. The pin joint connections 49 interconnect with the seat frame 16. Since the shoulder straps 50 pull on the connector rod 30 below the pin joint connections 49 and the locking strap set 62 pulls in the opposite direction above the pin joint connections 49, the seat frame 16 is presented with a rotational bias. The rotational bias acts to keep the folding backpack chair 10 in its folded configuration. It will, therefore, be understood that when the folding backpack chair 10 is closed and is worn as a backpack, the weight carried by the folding backpack chair 10 is used to help bias the backpack folding chair 10 into its folded configuration.

The weight of the folding backpack chair 10 and any load it carries is transferred to a person through the shoulder straps 50. The first end 52 of each of the shoulder straps 50 is attached to the crossbar element 36. The second end 56 of each of the shoulder straps 50 is attached directly to the connector rod 30 of the seat frame 16. As a result, all the forces borne by the shoulder straps 50 are transferred directly to the framework of the folding backpack chair 10. The shoulder straps 50 do not pull upon either the material of the seat or the material of the backrest.

It will be understood that the embodiment of the present invention folding backpack chair that is illustrated is merely exemplary. As such, it would be expected that a person skilled in the art can make variations to the shown embodiment using alternate chair frames and functionally equivalent components. All such variations, modifications and alternate embodiments are intended to be included within the scope of the present invention as defined by the claims.

What is claimed is:

1. A chair assembly, comprising:

a seat;

a leg framework that supports said seat at a predetermined elevation;

a backrest adjustable between a generally vertical position and a generally horizontal position, wherein said backrest has a rear surface;

a first pocket extending from said rear surface;

a second pocket extending from said rear surface, wherein a gap exists between said first pocket and said second pocket; and an auxiliary leg having two leg sections joined by a crossbar, wherein said leg sections are each connected to said backrest at pivot joints enabling said crossbar to rotate between a first position, where said crossbar abuts against said rear surface of said backrest within said gap, and a second position where said crossbar is separated from said rear surface.

2. The assembly according to claim 1, wherein said chair assembly is a folding chair assembly that is selectively configurable between an open configuration and a folded configuration.

3. The assembly according to claim 1, further including shoulder straps for carrying said chair assembly in said folded configuration.

4. The assembly according to claim 3, further including a set of locking straps that interconnect said backrest to said seat when said backrest and said seat are in said folded configuration, wherein said set of locking straps prevents said backrest and said seat from being moved into said open configuration.

5. The assembly according to claim 1, wherein said first pocket and said second pocket share a common length.

6. The assembly according to claim 1, wherein said first pocket is insulated.

7. The assembly according to claim 1, wherein said second pocket is insulated.

8. The assembly according to claim 1, further including separate closures for closing said first pocket and said second pocket.

9. The assembly according to claim 1, further including clips coupled to said auxiliary leg that engage said backrest and retain said auxiliary leg in said second position.

10. The assembly according to claim 1, further including two armrests, wherein each of said armrests interconnects with said leg framework.

11. A chair assembly, comprising:

a seat;

a framework that supports said seat at a predetermined elevation;

a backrest having a rear surface;

a first pocket extending from said rear surface;

a second pocket extending from said rear surface, wherein a gap exists between said first pocket and said second pocket; and an auxiliary leg pivotably connected to said backrest, said auxiliary leg being selectively movable between a folded position and an extended position, wherein said auxiliary leg extends around said first pocket, through said gap, and abuts against said rear surface of said backrest when in said folded position.

12. The assembly according to claim 11, wherein said chair assembly is a folding chair assembly that is selectively configurable between an open configuration and a folded configuration.

13. The assembly according to claim 11, further including shoulder straps for carrying said chair in said folded configuration.

14. The assembly according to claim 11, wherein said first pocket and said second pocket share a common length.

15. The assembly according to claim 11, wherein said first pocket is insulated.

16. The assembly according to claim 11, further including a closure for closing said first pocket.

17. The assembly according to claim 11, further including clips coupled to said auxiliary leg that engage said backrest and retain said auxiliary leg in said folded position.

* * * * *